US006823626B2

(12) United States Patent
Kinsey

(10) Patent No.: US 6,823,626 B2
(45) Date of Patent: Nov. 30, 2004

(54) WINDOW SASH TILT CONTROL

(76) Inventor: Bruce F. Kinsey, 16 White Dogwood Rd., P.O. Box 1936, Beaufort, SC (US) 29902

( * ) Notice: Subject to any disclaimer, the term of this patent is extended or adjusted under 35 U.S.C. 154(b) by 242 days.

(21) Appl. No.: 10/116,915

(22) Filed: Apr. 8, 2002

(65) Prior Publication Data

US 2002/0116873 A1 Aug. 29, 2002

Related U.S. Application Data

(63) Continuation-in-part of application No. 09/657,243, filed on Sep. 7, 2000, now abandoned.

(51) Int. Cl.[7] ..... E05D 15/22
(52) U.S. Cl. ..... 49/187
(58) Field of Search ..... 49/163, 176, 161, 49/187

(56) References Cited

U.S. PATENT DOCUMENTS 509,521 A * 11/1893 Frotscher ..... 49/187
1,297,892 A * 3/1919 Rudow ..... 49/187
1,388,121 A * 8/1921 Porter ..... 49/187
1,586,776 A * 6/1926 Bradley ..... 49/187
1,980,275 A * 11/1934 Julin ..... 49/187

FOREIGN PATENT DOCUMENTS

CA 539536 * 4/1957 ..... 49/187
GB 22865 * 10/1909 ..... 49/187

* cited by examiner

*Primary Examiner*—Jerry Redman

(57) ABSTRACT

A window assembly has a frame with balance channels to opposite sides of the frame, balance devices in the channels and a sash which is both slideable and tiltable relative to the frame. Also provided is a sash tilt limit bar which has a first end attached to the sash and a second end which is held within and which slides vertically in one of the balance channels without interfering with the balance device in the channel. The bar limits the tilting of the sash to positions which do not allow the second end of the bar to travel sufficiently far as to allow the bar to move to a position perpendicular to the frame where the bar might otherwise block closing of the sash.

9 Claims, 15 Drawing Sheets

FIG. # 1.
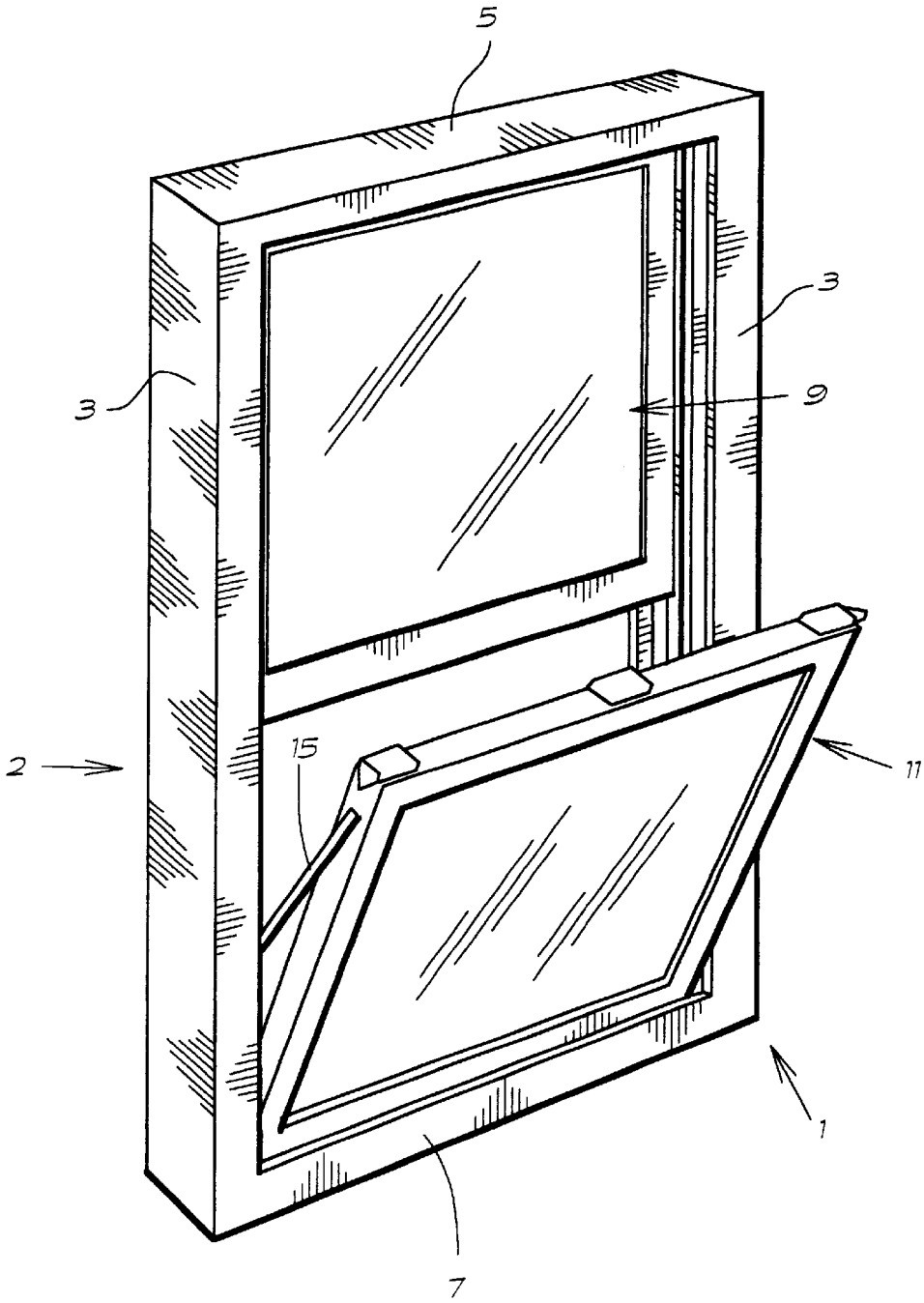

FIG. # 2.
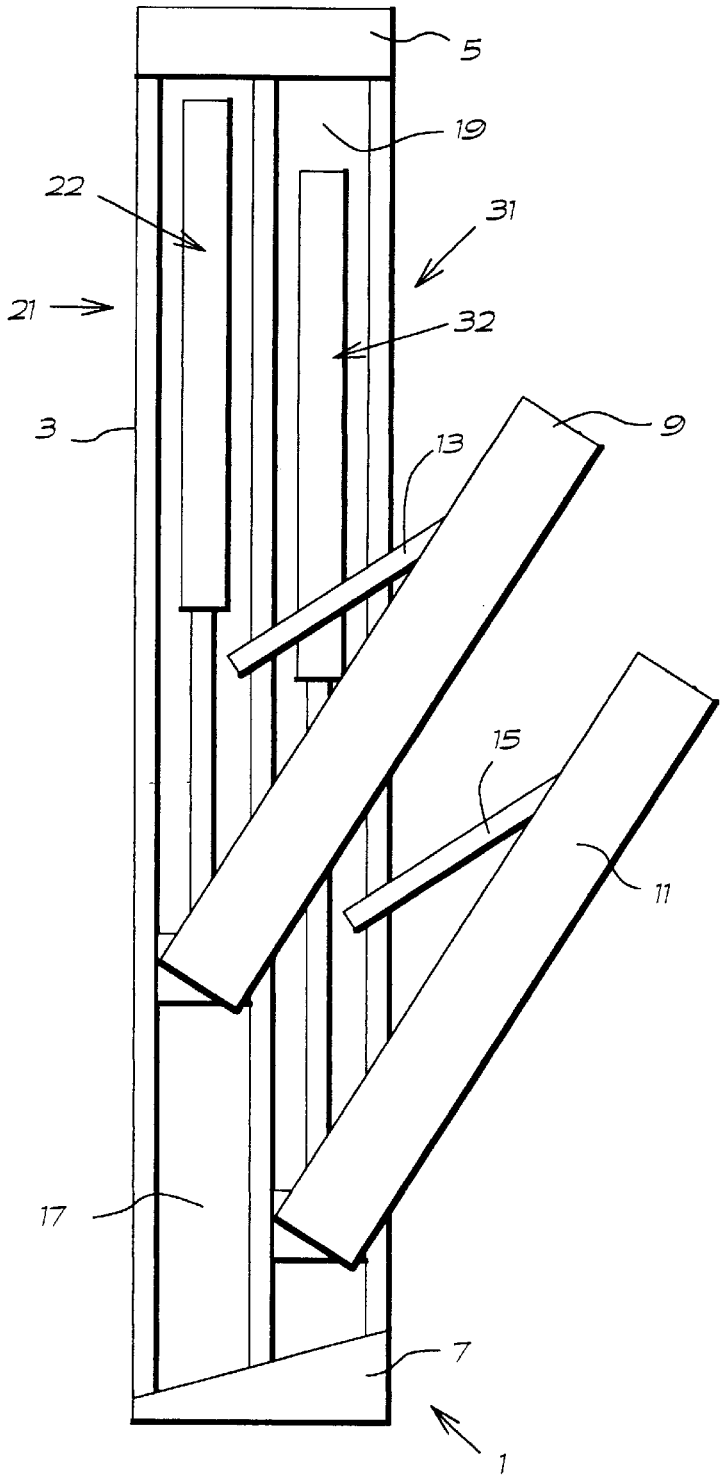

FIG. # 3.
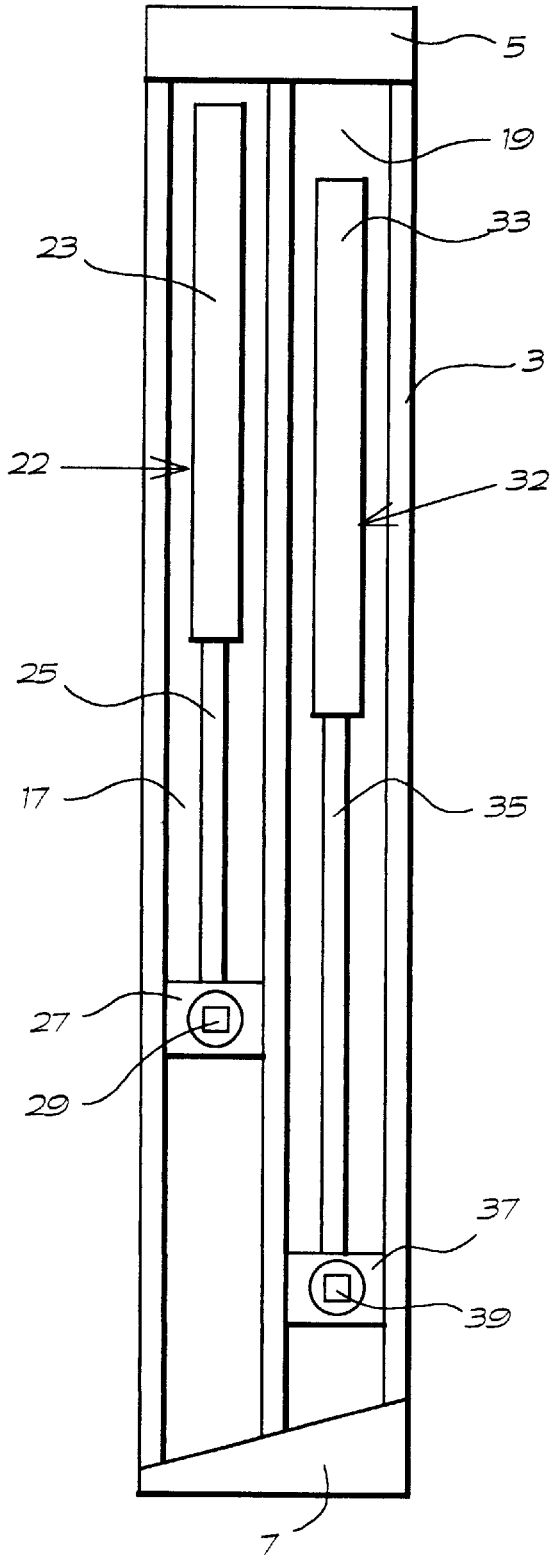

FIG. # 4.
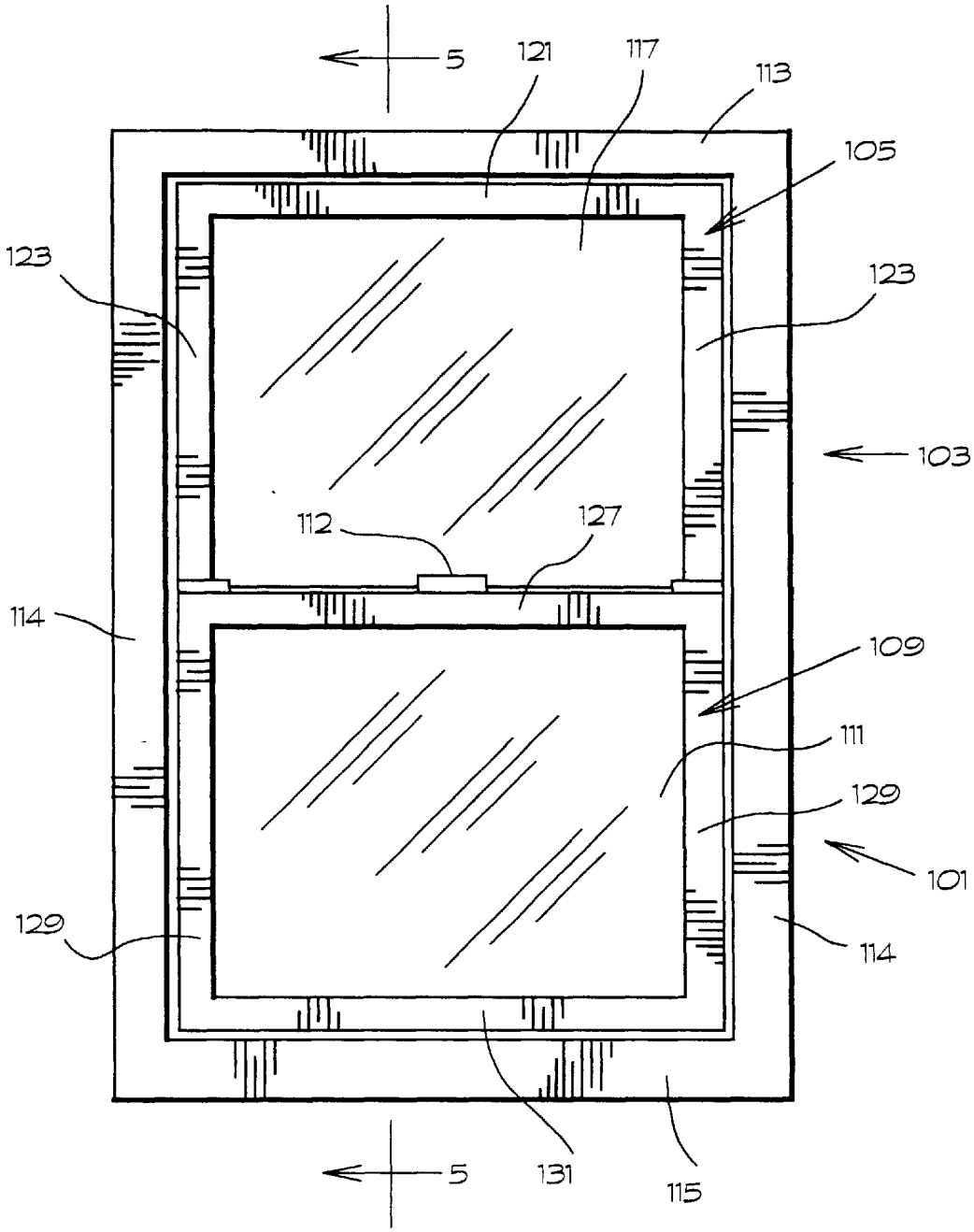

FIG. # 5.
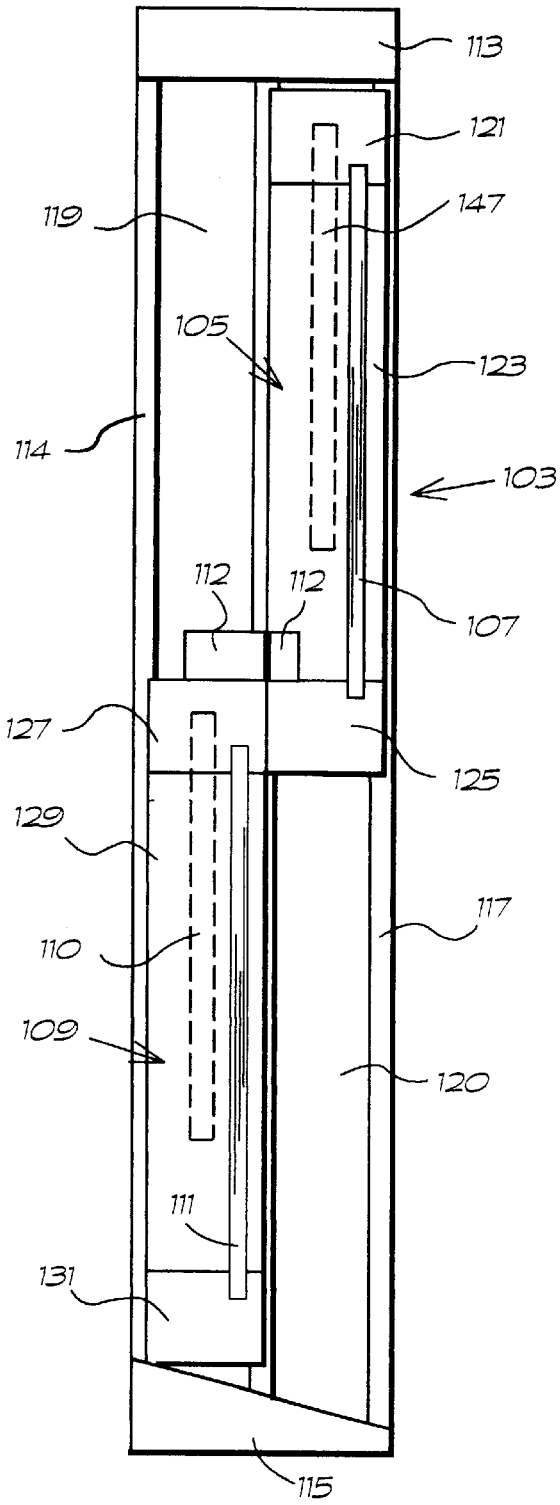

FIG. # 6.
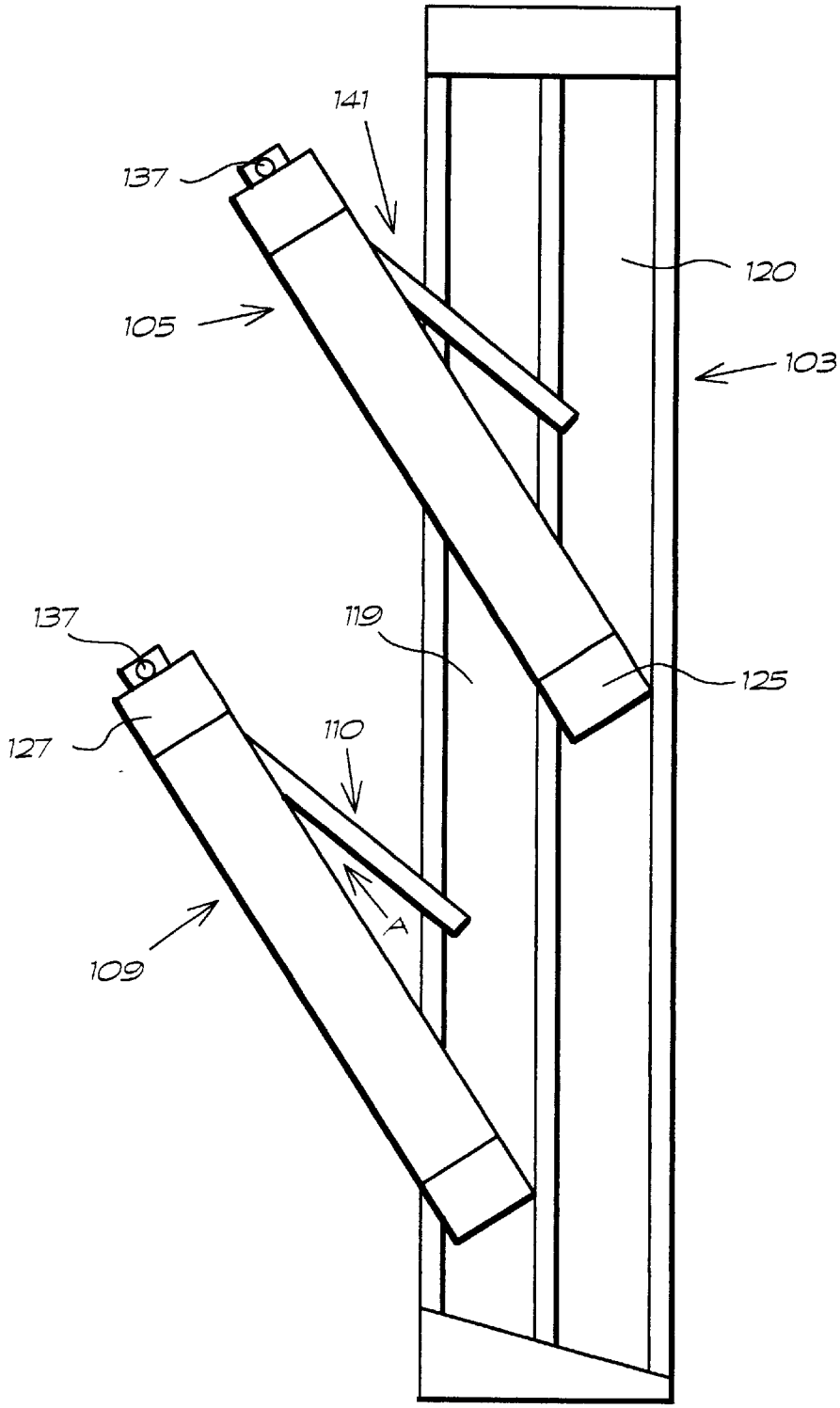

FIG. # 7.
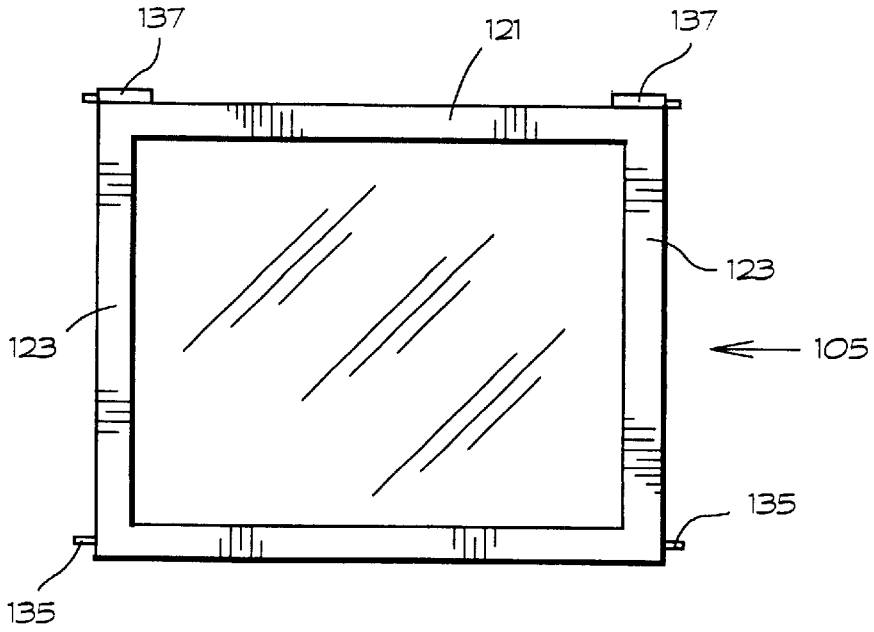
FIG. # 8.
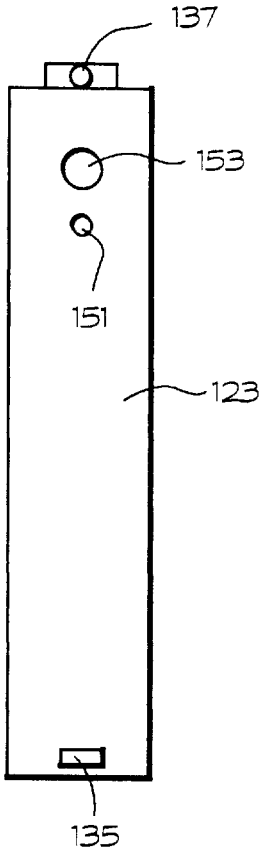
FIG. # 9.
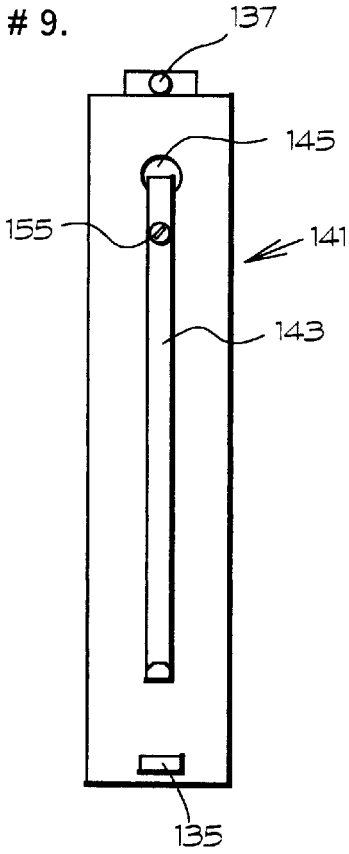

FIG. # 10.
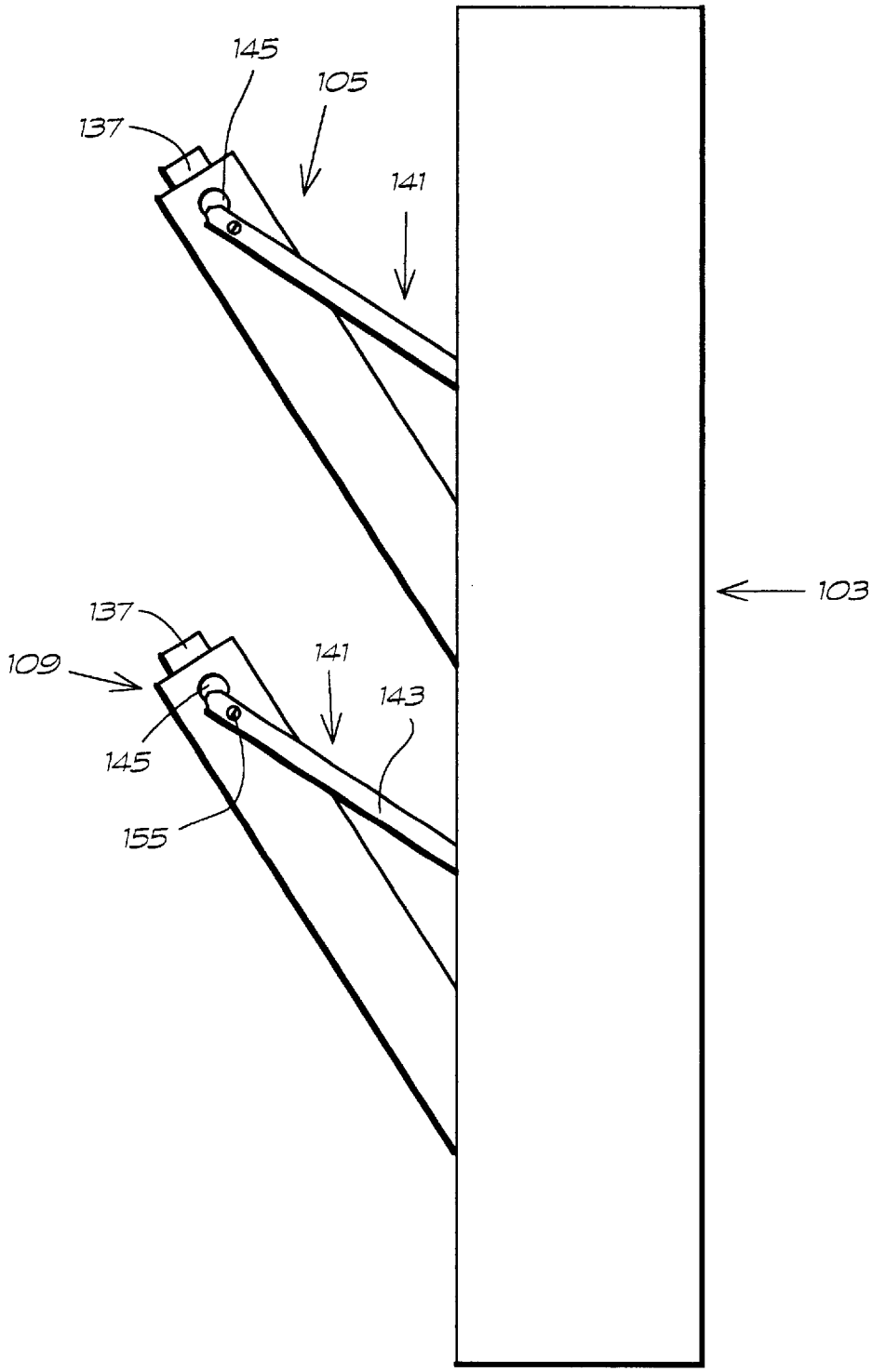

FIG. # 11.
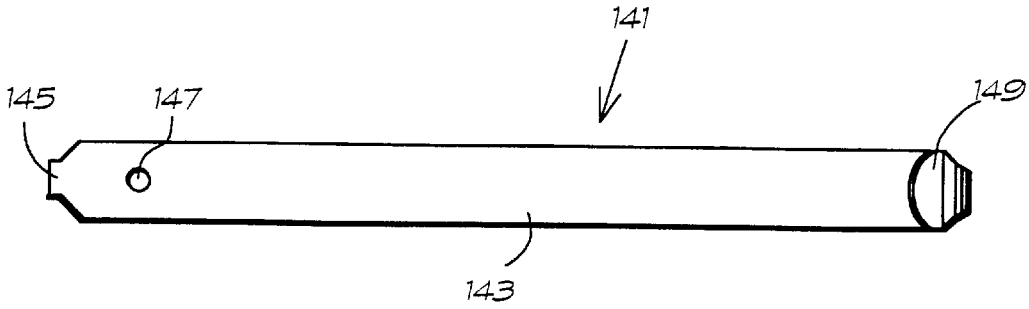
FIG. # 12.
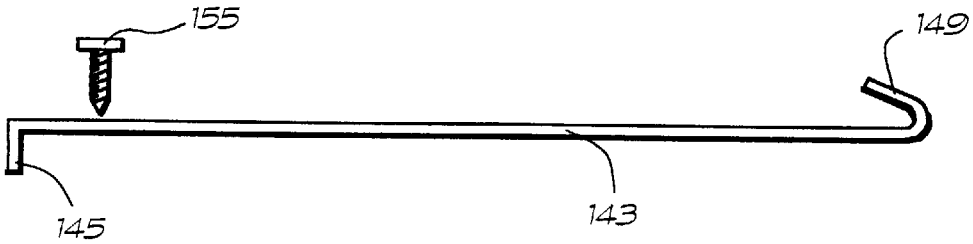
FIG. # 13.
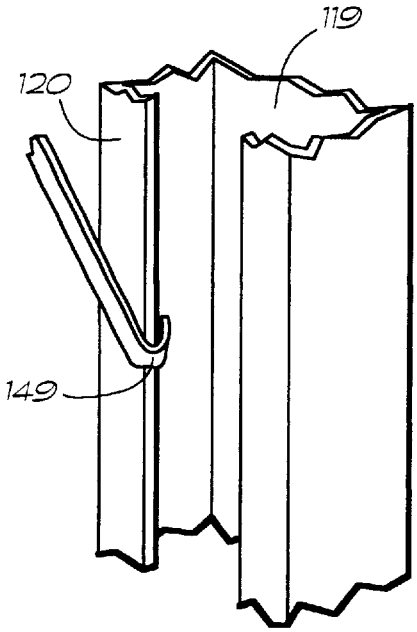

FIG. #14.
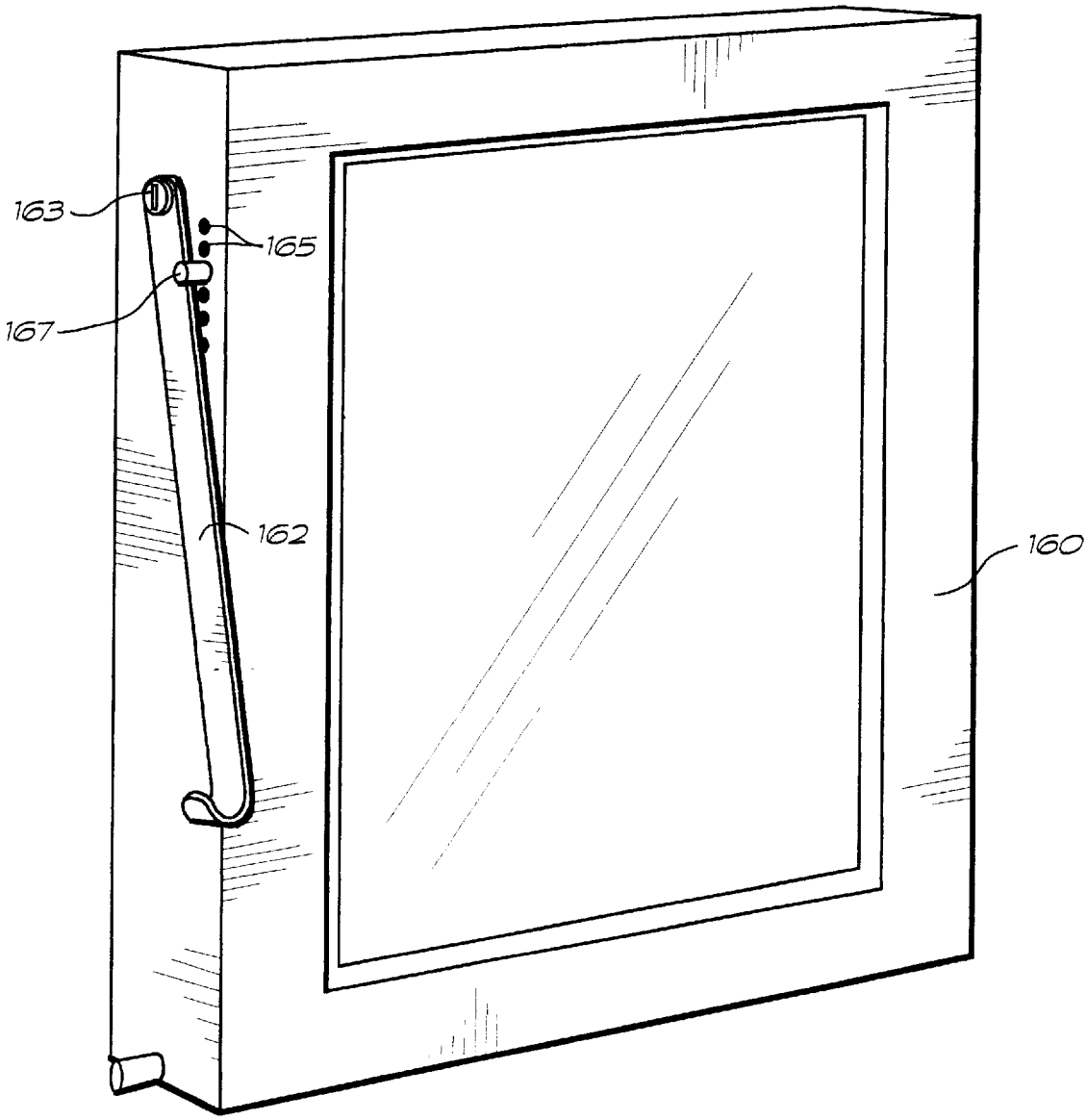

FIG. #15.
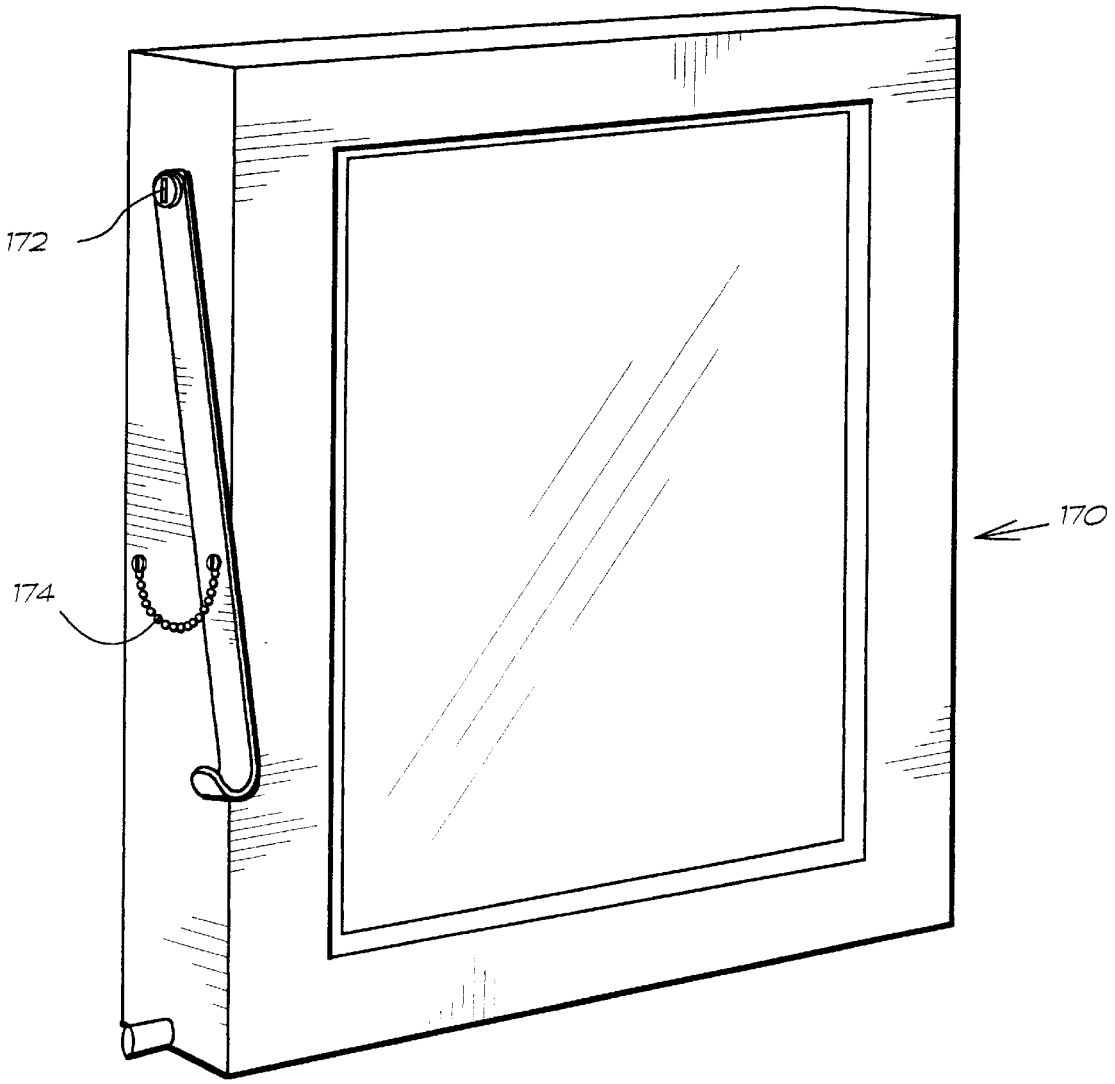

FIG. #16.
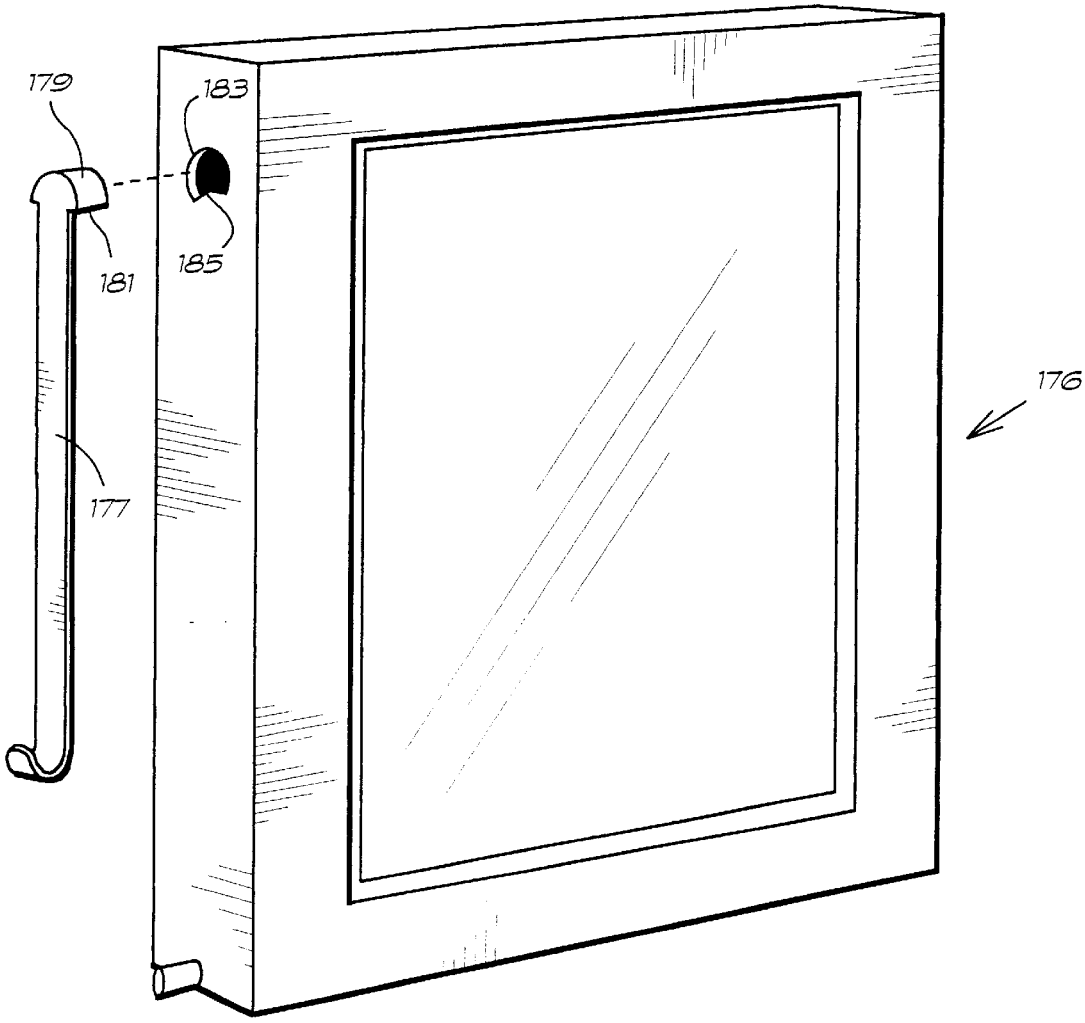

FIG. #17.
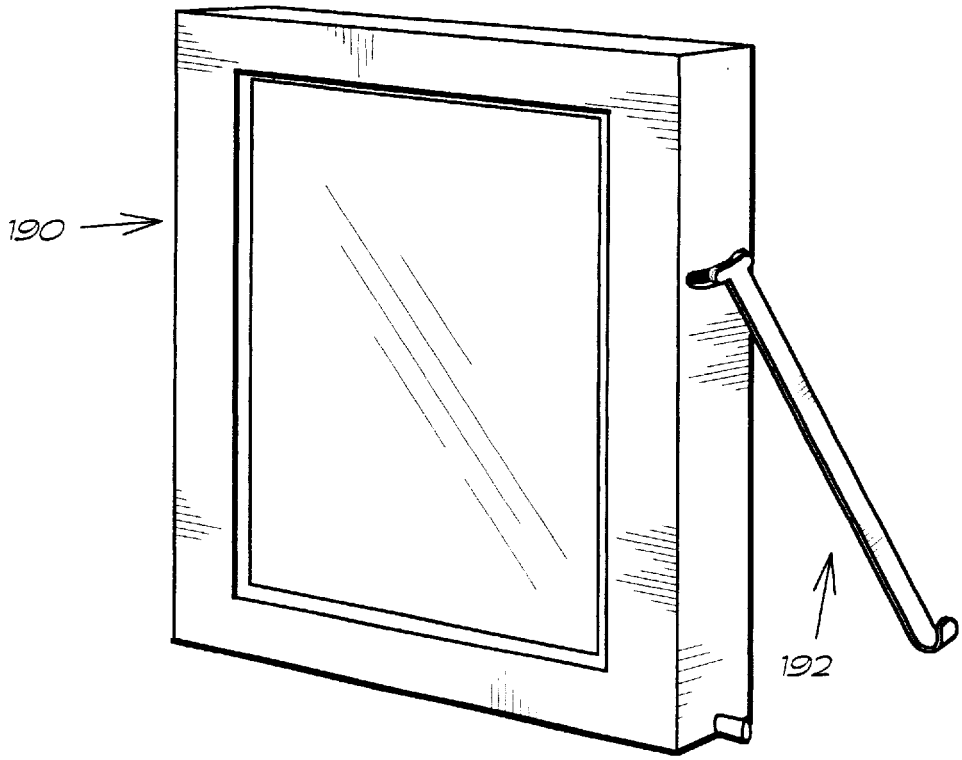
FIG. #18.
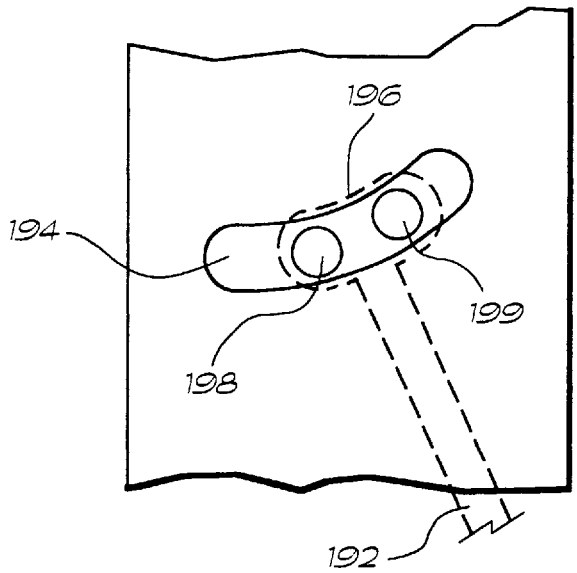

FIG. #19.
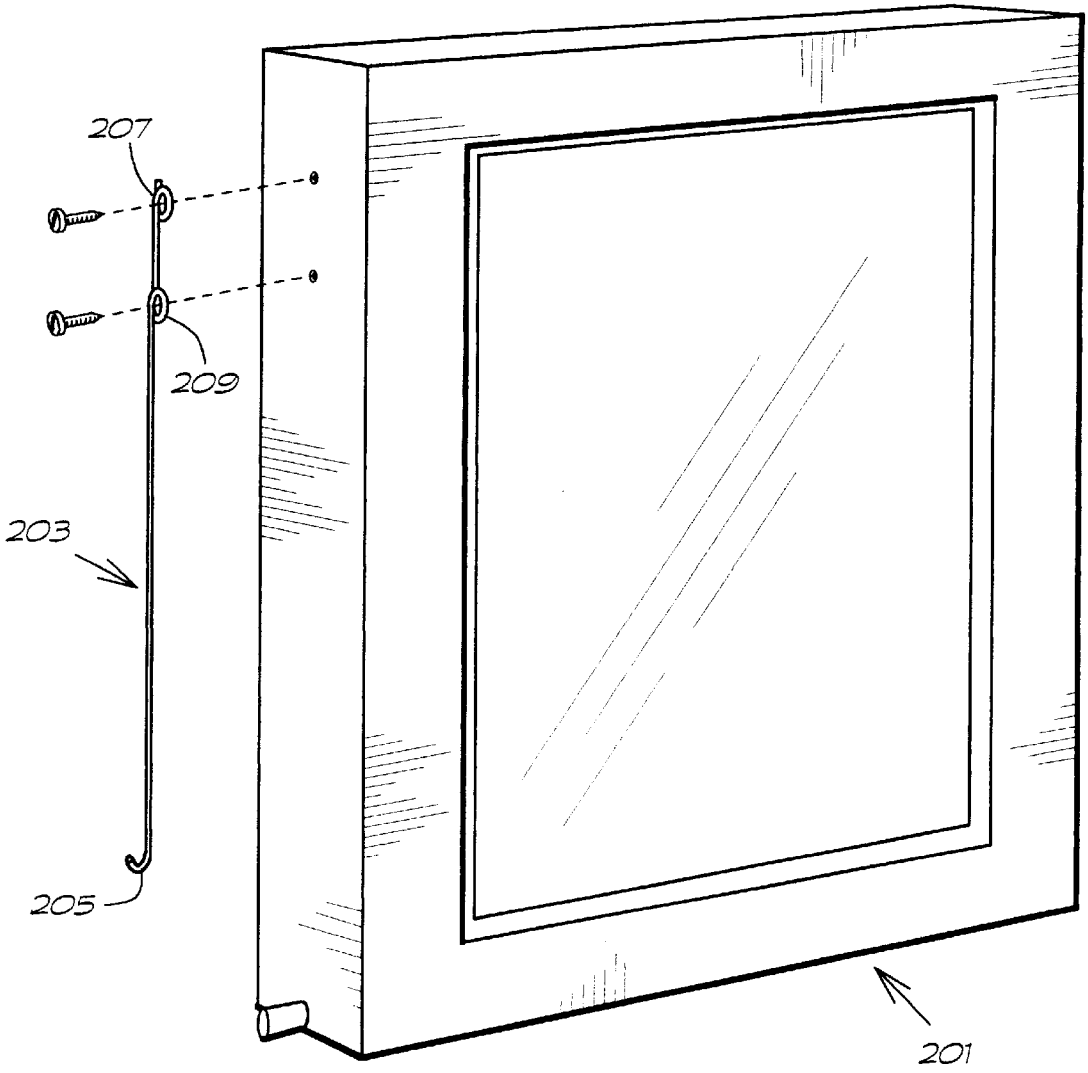

FIG. #20.
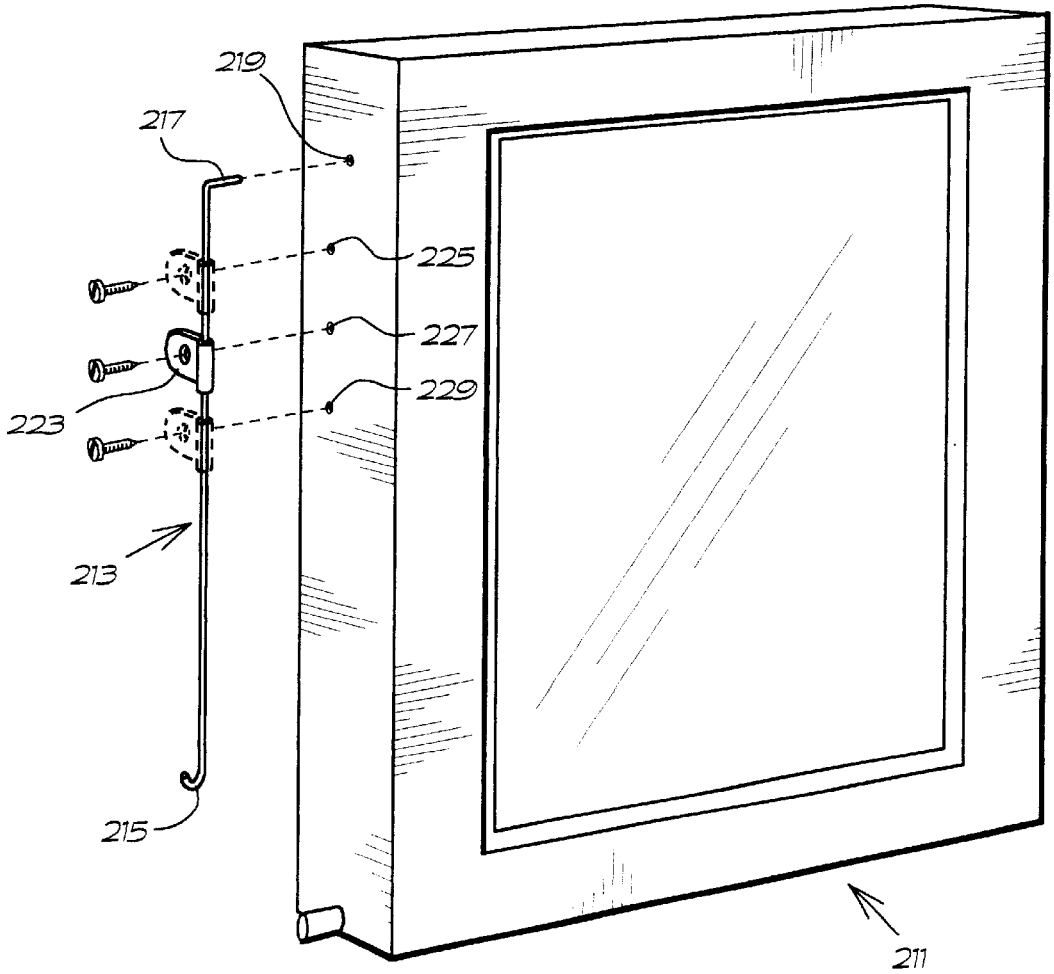

WINDOW SASH TILT CONTROL

This is a continuation in part of application Ser. No. 09/657,243, filed Sep. 7, 2000, abandoned as of the filing of this application.

FIELD OF THE INVENTION

The present invention relates to a window assembly with a sash which is both slideable and tiltable relative to the frame supporting the sash.

BACKGROUND OF THE INVENTION

Many of today's modern windows have sashes which are both slideable and tiltable relative to their supporting frames. The tilt feature adds the benefit that the sash can be cleaned when tilted to an open position. However, this same tilt feature can also be detrimental because current windows that have slideable and tiltable sashes do not include any type of a sash tilt control. Without this control the sash, if not properly handled by the person at the window, can easily fall completely out of the frame creating a very hazardous situation.

In a typical window having sliding and tilting sashes the frame jambs of the window usually have undercut openings known in the industry as balance pockets or channels. These channels contain balancing devices i.e., balance springs or the like which help to hold the sashes at different positions to which they are slid relative to the frame. Any sash tilt control that can be added to current window designs must not interfere with these balance devices. Furthermore, any such sash tilt control must not adversely affect the tilt opening or tilt closing of the sash.

The window industry is very competitive and as such any changes to known window assembly construction are not readily accepted both from a cost and a market appeal standpoint. Therefore, any modifications made to existing windows having slideable and tiltable sashes must be at very low cost and should be compatible with current window assembly design.

SUMMARY OF THE PRESENT INVENTION

The present invention provides a window assembly having a frame, a sash and a low cost sash tilt control which prevents the sash from tilting out of the frame and which is extremely compatible with existing window design.

More particularly, the window assembly of the present invention comprises a frame and a sash in which the frame is elongated relative to the sash and the sash is slideable to different vertical settings within the frame. The frame has side jambs with interior channels opening at the sash. Each of these channels is provided with a balancing device which slides with and balances weight of the sash at the different vertical settings of the sash in the frame.

The sash is further tiltable between a tilted closed and different tilted open positions relative to the frame.

The assembly includes a sash tilt control bar. This bar has a first end attached to the sash and a second end which is slideably held within one of the channels of the frame. The frame, the sash and the bar all vertically align with one another when the sash is in the tilted closed position where the bar is sandwiched between the frame and the sash.

When the sash is tilted open the second end of the bar slides vertically of the channel in which it is held. The vertical sliding of the second end of the bar does not interfere with the balance device in that channel. The vertical travel at the second end of the bar causes the bar to tip away from its vertical position towards a more horizontal position. However, the bar should not reach a fully horizontal position i.e., a position perpendicular to the frame where the bar might otherwise block the tilt closing of the sash. In order to avoid this problem, the bar limits the tilt opening of the sash to positions which do not allow the second end of the bar to travel sufficiently far as to allow the bar to move to a position perpendicular to the frame. This in turn stops the vertical travel of the second end of the bar before the bar tips to a position perpendicular to the frame as the sash is tilted open.

BRIEF DESCRIPTION OF THE DRAWINGS

The above as well as other advantages and features of the present invention will be described in greater detail according to the preferred embodiments of the present invention in which;

FIG. 1 is a perspective view looking down on a window assembly having first and second sashes, the first sash being in a closed position, the second sash being tilted open and both sashes being provided with sash tilt controls according to a preferred embodiment of the present invention;

FIG. 2 is a sectional view of the window assembly of FIG. 1 showing both sashes tilted open and the first sash being slid downwardly from its closed position of FIG. 1;

FIG. 3 is a view similar to FIG. 2 with the sashes and sash tilt controls removed from the window assembly;

FIG. 4 is a front view of a further window assembly made in accordance with a preferred embodiment of the present invention;

FIG. 5 is a sectional view along the lines 5—5 of FIG. 4;

FIG. 6 is a view similar to FIG. 5 showing the upper and lower sashes in tilted open positions;

FIG. 7 is a front view of either one of the sashes from the window assembly of FIG. 4 when removed from the supporting frame;

FIG. 8 is an end view of the sash of FIG. 7 without the tilt limit bar in position;

FIG. 9 is the same view as FIG. 8 but showing the tilt limit bar attached to the sash;

FIG. 10 is an end view of the window assembly of FIG. 4 with the two sashes tilted open relative to the frame;

FIG. 11 is a top view of a tilt limit bar according to a preferred embodiment of the present invention;

FIG. 12 is a side view of the tilt limit bar of FIG. 11;

FIG. 13 is a perspective view showing the engagement of the tilt limit bar with the balance channel of the frame for either one of the sashes from the window assembly of FIG. 4 with the sash tilted open as shown in FIG. 6;

FIGS. 14 through 17 are perspective views of sashes and sash tilt controls according to further preferred embodiments of the present invention;

FIG. 18 is an enlarged view of the outside edge of the sash stile of FIG. 17 showing in phantom the insertion of the end of the sash tilt control bar into the stile opening to receive the bar end;

FIGS. 19 and 20 are perspective views of sashes with sash tilt control arms according to further preferred embodiments of the invention.

DETAILED DESCRIPTION ACCORDING TO THE PREFERRED EMBODIMENTS OF THE PRESENT INVENTION IN WHICH

FIG. 1 shows a window assembly generally indicated at 1. This window assembly mounts in an opening of a building wall.

Window assembly 1 is built around a standard window construction and additionally includes novel features of the present invention added to that construction. The assembly 1 can be made from plastic, wood, aluminum or other suitable materials.

The assembly includes a frame 2 which supports sashes 9 and 11. These sashes are both slideable and tiltable relative to the frame. The frame is elongated relative to the sashes to accommodate slide opening and closing of the sashes.

The frame itself is formed of a pair of side jambs 3, header 5 and a sill 7. As seen in FIGS. 2 and 3 side jambs 3 include first and second channels 17 and 19. These channels have an undercut configuration with a relatively narrow mouth which faces at the sash within the frame. The channels widen behind their mouth walls to receive balancing devices generally indicated at 22 and 32.

Balancing device 22 comprises a fixed position cylinder 23. Extending from cylinder 23 is a rod 25 which slides relative to the cylinder. The cylinder contains means, e.g. a spring or the like, which provides resistance to the sliding of the rod. A sash mount 27 is provided on the lower end of rod 25. Sash mount 27 includes a pivot connector 29 to which the lower end of the sash 9 secures as to be described later in more detail.

Balancing device 32 has a similar construction to device 22 and includes a cylinder 33 fixed in channel 19, a rod 35 slideable relative to the cylinder and a sash mount 37 at the lower end of the rod. Sash mount 37 includes a pivot connector 39 which secures to the lower end of sash 11.

In comparing FIGS. 1 and 2 it will be seen that sash 9 is at different height settings in the frame. Balance device 22 is used to offset weight of the sash to hold these different settings. Sash 11 is also slideable to different height settings for a slide opening and closing of the window. Balance device 32 is used to help support sash 11 at these different height settings.

Each of the sashes 9 and 11 is also tiltable relative to the frame for a tilt opening and closing of the window. The sashes tilt open to different tilted settings and in accordance with the present invention tilt control bars 13 and 15 are provided to help hold the sashes in their different tilted positions. These tilt control bars pivotally secure at one of their ends to the respective sash and slideably engage at the other of their ends within the respective balance channel of the frame as also to be described later in more detail. The bars do not in any way interfere with the balance devices in the channels.

The description above shows very generally the window assembly construction including the sash tilt control feature of the window assembly. FIGS. 4 through 6 show, in greater detail, another window assembly which once again incorporates this same sash tilt control. For drawing clarity purposes, the balancing devices are not shown in these particular figures. They are, however, included in the window assembly of FIGS. 4 through 6 and they do operate in the same manner as that already described.

FIG. 4 shows an overall window assembly generally indicated at 101. This assembly comprises a frame 103 which mounts within a building opening and which supports upper and lower sashes 105 and 109 respectively.

Referring now to FIG. 5, frame 103 comprises a header 113, a sill 115 and opposite side jambs 114. Each of these jambs includes a front channel 119 and a rear channel 120. These two channels which contain balancing devices that are not shown extend essentially the complete height of the frame.

Sash 105 comprises a header 121, a sill 125 and side jambs or stiles 123. The header, sill and jambs of sash 105 hold a glass pane 107.

The sash 109 is formed by a header 127, a sill 131 and opposite side jambs 129. The header, sill and jambs of sash 109 contain a glass pane 111.

The side jambs 123 of the upper sash and more particularly the pivot pins and the spring locks of the jambs are slideably received within frame channel 120 while the pivot pins and spring locks of the side jambs 129 of the lower sash are slideably received within frame channel 119. In order to prevent sliding of the two sashes relative to one another, i.e. for locking the window closed, the window is provided with a lock mechanism 112 having cooperating locking parts on the sill of the upper sash and the header of the lower sash.

The two sashes are not only slideable but additionally they are tiltable relative to the frame. As better shown in FIG. 7 of the drawings, each of the sashes, as represented by sash 105, has a lower end pin 135 and an upper end spring lock 137. The pins connect to the pivot connectors of the sash mounts of the balance devices as earlier described with respect to FIGS. 1 through 3. The pins then ride within the frame channel as do the two spring locks when the locks are in the position shown in FIG. 7. However, the two spring locks are retractable to allow the upper end of the sash to release from the frame for tilt opening of the sash. FIG. 6 of the drawings shows the two sashes in their tilted open positions.

Again, the key to the present invention lies in the provision of a tilt control bar unique to the present invention.

An example of a preferred embodiment tilt control bar generally indicated at 141 is best seen in FIGS. 11 and 12 of the drawings. The bar is used with sash 105. A similar bar 110 is used with sash 109.

Bar 141 includes an elongated bar portion 143 terminated at one end with a short right angle leg portion 145 and a small hole 147 through the main body of the bar near the short leg. The other end of the bar is provided with a hook-like member 149 which extends to the opposite side of the main body of the bar from leg portion 145.

Returning to FIG. 8, it will be seen that the outside surface of the sash jamb 123 includes a pair of vertically spaced holes 151 and 153. Hole 153 is larger than hole 151.

Tilt limit bar is mounted to sash jamb 123 by means of a screw 155 which fits through opening 147 in the bar and threads into sash opening 151. Leg 145 of the bar locates within sash opening 153. The sash opening is oversized relative to the leg allowing the leg some play within the sash opening. However the amount of play is limited to provide a bar movement controller as described later in more detail.

As earlier mentioned the window frame includes channels 119 and 120. These channels not only contain the sash balancing devices but in addition are used to trap one end of the tilt limit bars on each of the sashes.

More particularly, referring to FIG. 13, it will be seen that the hooked end 149 of bar 141 wraps around and locks onto the mouth wall 120 of the undercut balance channel 119. This in no way prevents sliding action of the sash within the frame nor does it interfere with the operation of the balance device. The hooked end of the bar slides vertically of the channel at the same time as, and always stays above, the sash mount of the balance device.

As also earlier mentioned the tilt bar leg portion 145 has some play within the sash jamb opening 153. The mounting of the tilt bar by means of screw 155 in combination with the leg play noted immediately above provides a tilt bar movement controller. This controller limits the amount of pivotal movement of the bar at the sash. The limiting of this pivotal movement in turn controls the amount of vertical slide of the other end of the bar in the frame channel. This is important because the bar should never reach a position perpendicular to the frame where it could easily block the tilt closing of the sash.

More particularly, when the sash is tilted closed the tilt control bar aligns with and is sandwiched between the sash and the frame as shown in dotted lines in FIG. 5. When the sash is tilted open the control bar begins to tip from its FIG. 5 vertical position towards a more horizontal position. During the tipping of the bar two things happen. Firstly, there is a pivoting movement at the connection of the one end of the bar to the sash and secondly the other end of the bar starts to slide vertically i.e., upwardly within the frame channel. However, the bar movement controller, which in this case is leg portion 145 of the bar 141, controls the amount of pivot at the one end of the bar which sets the degree to which the bar is allowed to tip. As soon as the pivoting movement at the sash end of the bar is stopped by the controller, the other end of the bar can no longer ride upwardly in the channel. This happens before the bar can reach the fully horizontal i.e., frame perpendicular position.

In the preferred embodiment as shown the pivot movement between the bar and the sash is controlled to allow the bar to swing or tip through a maximum angle of about 15°. This angle is indicated at A in FIG. 6. At this angle of the bar the sash reaches its maximum tilted open position of about 45° relative to the frame. This is a position from which the sash can easily be pushed closed.

Another feature of the present invention is that the tilt bar, although normally in its frame engaged position can easily be manually released from the frame. This is done by pushing the sash, when tilted open, towards the closed position and holding the bar from sliding downwardly along the frame channel. By doing this the hooked end of the bar is pushed off of the mouth wall of the balance channel. The bar can then be pushed or flexed inwardly to move the hooked end of the bar out of the channel. When the bar is moved to this disengaged position, the sash can be tilted open as far as desired for cleaning or maintenance purposes.

Although the drawings and description above show the tilt limit bar being used in a double hung window, it could equally as well be used in a single hung window. Furthermore, the degree to which the sash is allowed to tilt relative to the frame could easily be modified from the 45° angle described above. The sash should however be limited to a tilt angle of something less than 90° when under the control of the bar.

The embodiments described above show only a few of the ways in which to prevent the tilt control bar from reaching a position perpendicular to the frame. Other embodiments of the invention fulfilling the same function are shown in FIGS. 14 through 20 of the drawings. Note that in each of these drawings the sash and the tilt control arm are shown away from the frame but it will be readily understood from each of the figures how they interact with the frame.

FIG. 14 shows a sash 160. A tilt control bar 162 is pivotally mounted at its one end by pivot mount 163 to the sash. The other end of the bar has a hooked end for engaging the balance channel of the frame in the same manner as that found in the earlier embodiments.

In this particular embodiment, the bar movement controller which limits the amount of pivot of the bar relative to the sash is in the form of a pin 167 supported by the sash. The edge of the bar will engage the pin when the sash has reached the degree to which it is allowed to tilt in its fully tilted open position. When the sash reaches this position the tilt control bar is well away from reaching a frame perpendicular position.

In the embodiment shown in FIG. 14, the sash is provided with a plurality of insert holes 165 to selectively receive the pin 167. When the pin is inserted into the uppermost of the holes 165 the sash will be allowed to tilt farther open than it would be if the pin is positioned in one of the lower holes. Therefore, in this embodiment the maximum tilt angle of the sash is adjustable by virtue of the positioning of pin 167.

FIG. 15 shows a sash 170 with a tilt limit bar pivotally mounted at 172 to the sash. Also provided in this embodiment is a flexible or bendable bar movement controller in the form of a chain 174 having one end secured to the bar and the other end secured to the sash.

As will be appreciated from FIG. 15 the sash will reach its maximum tilted open position when the chain is extended to its maximum length. The chain then stops the pivotal movement between the control bar and the sash. This occurs well before the bar is able to reach a position perpendicular to the frame.

FIG. 16 shows a sash generally indicated at 176. A tilt control bar 177 is used to determine the maximum tilted open position for the sash.

In this particular embodiment, bar 177 is provided with a right angular extension 179. This extension, as shown, has a semi-circular configuration with a rounded side 179 and a flat side 181.

Sash 176 is provided with an opening for receiving the extension 179. This opening is defined by a rounded wall part 183 and a flat wall part 185. The rounded wall part circumscribes more than 180 degrees of a circle e.g., something in the neighborhood of about 240 degrees of a circle. This allows a limited pivot of the extension 179 within the opening. The amount of pivot is dictated by the flat edge surface 181 of the extension abutting the flat wall 185 of the opening of the sash. This occurs when the sash has been tilted to its maximum tilted open position of for example, 15 degrees relative to the frame.

FIGS. 17 and 18 show another embodiment of the invention. In this embodiment, a tilt control arm 192 fits with a sash 190. As best shown in FIG. 18 this sash includes a curved slot 194 and the control arm includes a head 196 having a pair of pivot pins 198 and 199 located within the slot 196.

The provision of the two spaced apart pivot pins prevents the head of the arm from rotating relative to the sash.

The sash will tilt open to the point where the pivot pin 199 runs into the upper blind end of the slot 194. This then blocks any further tilt opening of the sash.

It is to be understood that in each of the embodiments shown in FIGS. 14 through 18 the hooked end of the control bars shown in these figures will once again rise in the frame channel. Furthermore this occurs without interfering with the balance device located in the channel in the same manner as disclosed with respect to FIGS. 4 through 11 of the drawings. Also like the FIGS. 4 through 11 embodiment, the amount of pivot at the sash end of the bar is controlled to limit the amount of vertical travel of the hook end of the bar thereby preventing the bar from tipping to a frame perpendicular position.

FIGS. 19 and 20 show still further embodiments of the invention. In each of these embodiments, to be described in more detail below, a sash is fitted with a tilt control bar where the bar once again has a hooked end to slide vertically within a balance channel of a frame. However, unlike the earlier described embodiments the control bar does not pivotally mount to the sash but rather it is the nature of the construction of the bar itself which provides the bar movement control.

More specifically, FIG. 19 shows a sash 201 removed from a frame which slideably and pivotally holds the sash. Provided to one side of the sash is a tilt control bar generally indicated at 203. This tilt control bar is made from a bendable spring steel material.

Bar 203 is provided with a hooked end 205 which hooks onto and slides along the channel mouth wall of the frame which receives sash 201.

The control bar is formed with two loops 207 and 209 directly within the body of the control bar. Fastening devices such as screws or the like are then fitted through the loops into the sash to secure the control bar to the side of the sash.

In this embodiment, as the sash is tilted open, the hooked end of the bar once again slides upwardly along the mouth wall of the channel without interfering with the balance device in the channel. However, the bar does not pivot relative to the sash because of the spaced apart mounting locations of the bar to the sash. Instead the bar bends between the loop 209 and the hooked end 205 of the bar. The amount of bend in the bar is dependent on the strength of the bar material. In all instances using the bar 203 the bar material would be sufficiently strong to prevent the sash from tilting to a frame perpendicular position.

FIG. 20 shows another embodiment using a bendable tilt control bar 213 which fits with a sash 211. In this embodiment, the control bar has a right angle extension 217 at one end of the bar and a hook 215 at the other end of the bar. The extension 217 secures within a sash opening 219. The hook 215 slideably mounts to the mouth wall of the channel of the frame which receives sash 211.

Additionally provided is a bar to sash fastening device 223. The sash includes openings 225, 227 and 229 to selectively receive a screw or the like to attach fastening device 223 to the sash.

The provision of the extension 217 secured within the sash and the mounting of the fastening device 223 spaced from extension 217 prevent the bar from rotating relative to the sash. As the sash is tilted open the hooked end 215 of the bar once again slides vertically upwardly along the balance channel without interfering with the balance device in the channel. At the same time the bar bends between fastening device 223 and the hooked end 215 of the bar. The resiliency and stiffness of the bar dictate the degree to which the sash can be tilted open. In all instances, the sash will not tilt to a position in which the sliding end of the bar travels sufficiently far to place the bar in a frame perpendicular position.

When the fastening device 223 is secured at sash opening 225 the sash will tilt farther open than it will when the fastening device is secured at sash opening 227. The least amount of tilt is provided when the fastening device is secured at sash opening 229. The reason for this is that the lower the fastening device is located along the body of the bar, the less the bar will bend. By lowering the fastening device there is a decrease in the length of bar material between the fastening device and the hooked end of the bar. This stiffens the bar in the region where the bar bends with the tilt opening of the sash.

Although various preferred embodiments of the present invention have been described in detail, it will be appreciated by those skilled in the art that variations may be made without departing from the spirit of the invention or the scope of the appended claims.

What is claimed is:

1. A window assembly comprising a frame and a sash, the frame being elongated relative to the sash and the sash being slideable to different vertical settings in the frame, said frame having side jambs with interior channels opening at the sash, each of said channels being provided with a balancing device which slides with and balances weight of said sash at the different vertical settings of the sash in the frame, said sash also being tiltable between a tilted closed position and different tilted open positions relative to the frame, said assembly further including a moveable sash tilt limit bar and a bar movement controller, said bar having a first end pivotally attached to said sash and a second end which is slideably held within one of the channels of the frame, said frame, said sash, and said bar all being vertically aligned with one another and said bar being sandwiched between said frame and said sash when the sash is in the tilted closed position, the first end of the bar being secured by a pivoting mounting to the sash and pivoting at the sash as the sash is tilted open causing the second end of the bar to slide vertically relative to the one of the channels of the frame within which the second end of the bar is slideably held without interfering with the balance device therein resulting in a horizontal tipping of the bar as the sash is tilted open, said bar movement controller limiting the pivoting at the first end of the bar to stop vertical travel of the second end of the bar before the bar tips to a position perpendicular to the frame when the sash is tilted open.

2. A window assembly as claimed in claim 1 wherein the bar movement controller comprises a leg portion extending from and at a right angle to said first end of said bar, said leg portion being located within an opening in said sash, the opening being oversized in diameter relative to said leg portion to provide a tilt limited fitting of the leg portion within the opening, said pivotal mounting of said first end of said bar to said sash being next to said leg portion between said leg portion and said second end of said bar.

3. A window assembly as claimed in claim 1 wherein said bar movement controller comprises a bendable member having a first end secured to the sash and a second end secured to the bar, the bendable member being moveable between a collapsed position when the sash is closed and a fully extended position with the sash tilted open, the bendable member when in the fully extended position preventing further tilt opening of the sash to stop pivotal movement between the first end of the bar and the sash.

4. A window assembly as claimed in claim 1 in which the first end of the bar has a pivot member which fits within a slot of the sash, the slot having an end stop which engages with the pivotal member of the first end of the bar when the sash is tilted open to stop pivotal movement between the first end of the bar and the sash.

5. A window assembly as claimed in claim 1 wherein the pivotal mounting of the first end of the bar to the sash is provided by a fixed pivot and wherein the sash is provided with a lateral projection against which the bar moves when the sash is tilted open to stop pivotal movement between the first end of the bar and the sash.

6. A window assembly as claimed in claim 5 wherein the lateral projection is adjustable in position vertically of the sash to enable different fully tilted open positions of the sash relative to the frame.

7. A window assembly as claimed in claim 1 wherein the sash tilt control bar limits the tilt opening of the sash to a maximum angle of about 45 degrees relative to the frame.

8. A window assembly as claimed in claim 1 wherein the second end of the bar comprises a hook which hooks into the balance channel of the frame.

9. A window assembly as claimed in claim 8 wherein the hook is manually releasable from the balance channel of the frame to disengage the control bar from the frame and allow unlimited tilting of the sash.

* * * * *